US010085540B2

(12) United States Patent
Choi et al.

(10) Patent No.: US 10,085,540 B2
(45) Date of Patent: Oct. 2, 2018

(54) COSMETIC COMPOSITION APPLICATOR INCLUDING IMPERMEABLE SHEET

(71) Applicant: AMOREPACIFIC CORPORATION, Seoul (KR)

(72) Inventors: Jung Sun Choi, Yongin-si (KR); Kyung Ho Choi, Yongin-si (KR)

(73) Assignee: AMOREPACIFIC CORPORATION, Seoul (KR)

( * ) Notice: Subject to any disclaimer, the term of this patent is extended or adjusted under 35 U.S.C. 154(b) by 0 days.

(21) Appl. No.: 15/315,004

(22) PCT Filed: Jun. 1, 2015

(86) PCT No.: PCT/KR2015/005477
§ 371 (c)(1),
(2) Date: Nov. 30, 2016

(87) PCT Pub. No.: WO2015/183055
PCT Pub. Date: Dec. 3, 2015

(65) Prior Publication Data

US 2017/0202336 A1 Jul. 20, 2017

(30) Foreign Application Priority Data

May 30, 2014 (KR) ..... 10-2014-0066106
Jun. 1, 2015 (KR) ..... 10-2015-0077259

(51) Int. Cl.
*A45D 33/34* (2006.01)
*A45D 33/00* (2006.01)

(52) U.S. Cl.
CPC ..... *A45D 33/34* (2013.01); *A45D 33/00* (2013.01)

(58) Field of Classification Search
CPC ..... A45D 33/00; A45D 33/34; A45D 2200/1009; A45D 34/04
See application file for complete search history.

(56) References Cited

U.S. PATENT DOCUMENTS

2015/0079862 A1* 3/2015 Jeong ..... A45D 34/00 442/1

FOREIGN PATENT DOCUMENTS

| | | |
|---|---|---|
| JP | 5595611 | 7/1980 |
| JP | 200754161 | 3/2007 |
| JP | 3985916 | 7/2007 |
| KR | 2020110011162 | 12/2011 |
| KR | 1020130122560 | 11/2013 |
| KR | 1020130134604 | 12/2013 |
| KR | 200472813 | 5/2014 |

OTHER PUBLICATIONS

International Search Report—PCT/KR2015/005477 dated Sep. 1, 2015.
Written Opinion—PCT/KR2015/005477 dated Sep. 1, 2015.
European Search Report—European Application No. 15800151.1 dated Feb. 5, 2018.

* cited by examiner

*Primary Examiner* — Yan Lan
(74) *Attorney, Agent, or Firm* — Cantor Colburn LLP

(57) ABSTRACT

The present invention relates to a cosmetic composition applicator including an anti-contamination layer including an impermeable sheet. The applicator, according to the present invention, can prevent contamination and discoloration by a cosmetic composition or external influences caused by germs and the like, and thus is easy to use and hygienic.

12 Claims, 2 Drawing Sheets

【FIG. 1】
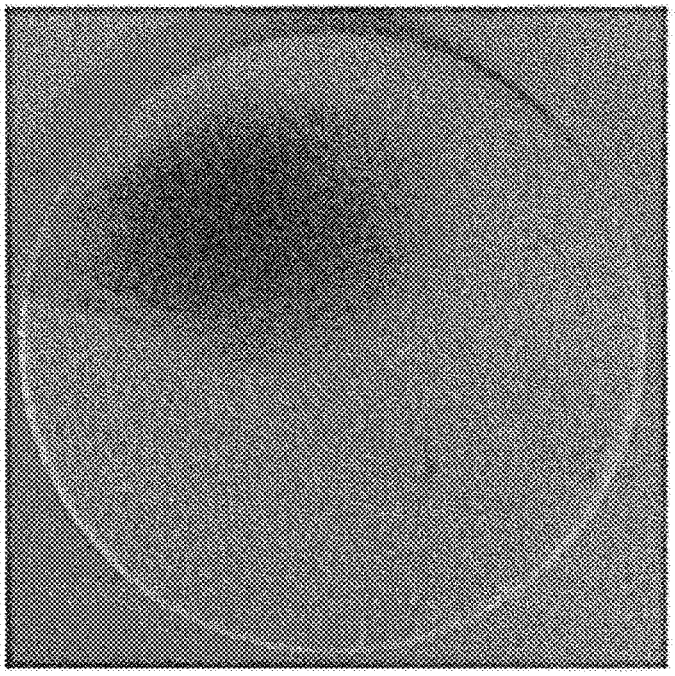
【FIG. 2】
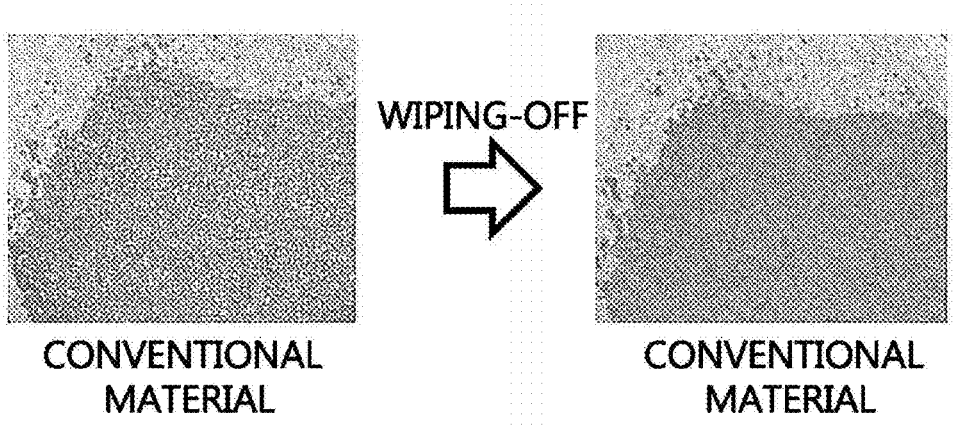

【FIG. 3】
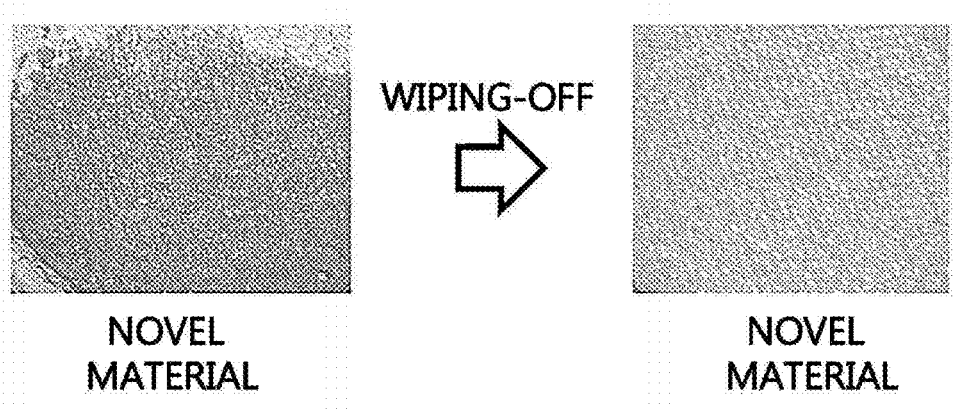

COSMETIC COMPOSITION APPLICATOR INCLUDING IMPERMEABLE SHEET

TECHNICAL FIELD

The present disclosure relates to a cosmetic composition applicator, which is subjected to anti-contamination treatment, and thus has antibacterial activity and an effect of preventing adsorption of contaminants.

BACKGROUND ART

As liquid cosmetic compositions have been carried with the users more frequently and the use of a cosmetic composition applicator has been increased, it is required for the applicator to have a shape with high safety and convenience. Although conventional portable containers also have an applicator embedded therein, the applicator is problematic in that it has a poor feel of grip in a hand and the applicator itself is contaminated and discolored to show poor hygienic property.

A pact type container, which allows the user to carry a cosmetic composition with ease, is provided with a sponge processed to have a small thickness and embedded therein, and thus the user carries the pact type container and performs makeup or modifies makeup in the outdoor with ease. However, such a cosmetic composition applicator embedded in a container may be contaminated with oil and water, face sebum or external dust during its use, or may be contaminated with bacteria under a certain high-temperature high-humidity condition, while it is stored in the container for a long time after being embedded therein. In addition, the cosmetic composition may be contaminated secondarily due to the continuous use of such a contaminated applicator. Further, the cosmetic composition applied to the applicator may not be removed by washing to make the appearance dirty, resulting in degradation of aesthetic characteristics.

Therefore, it is required for an applicator to have antibacterial activity capable of preventing bacterial contamination for the purpose of its clean and safe use. It is also required to select and process the materials of an applicator to remove contaminants with ease even after the applicator is contaminated.

REFERENCES

Patent Documents

Japanese Patent Laid-Open No. 2007-054161

DISCLOSURE

Technical Problem

A technical problem to be solved by the present disclosure is to provide a cosmetic composition applicator, which can be prevented from contamination caused by external bacteria and cosmetic composition and can be used cleanly and easily without discoloration.

Technical Solution

In one general aspect, there is provided a cosmetic composition applicator including an application layer for applying a cosmetic composition to the skin, and an anti-contamination layer stacked on the top of the application layer, wherein the anti-contamination layer includes an impermeable sheet.

Advantageous Effects

According to the embodiments of the present disclosure, the applicator includes an anti-contamination layer on the back surface of the application layer, so that the portions other than the application layer functioning to apply a cosmetic composition to the skin may not absorb the cosmetic composition, particularly containing water, oil or pigments, but bounce the cosmetic composition. In addition, when the applicator is contaminated with the cosmetic composition, it is possible to remove the cosmetic composition with ease by virtue of such non-absorbing characteristics. Thus, the cosmetic composition applicator according to the present disclosure has antibacterial activity and causes no discoloration, and thus is useful for an applicator embedded in a cosmetic container or applying a cosmetic composition.

DESCRIPTION OF DRAWINGS

FIG. 1 is a photographic image illustrating a cosmetic composition taken by a cosmetic composition applicator made of acrylonitrile-butadiene rubber (NBR) and including no anti-contamination layer as Comparative Example.

FIG. 2 is a photographic image illustrating the results of a contaminant removal test for the cosmetic composition applicator including no anti-contamination layer as Comparative Example.

FIG. 3 is a photographic image illustrating the results of a contaminant removal test for the cosmetic composition applicator including an anti-contamination layer according to an embodiment of the present disclosure.

BEST MODE

As used herein, 'applicator' means an instrument for use in delivering any material or ingredient to the skin, and is used in its broadest meaning covering all types of applicators, such as a puff, tip, and the like.

As used herein, 'sheet' means a member stacked on at least one surface of an applicator, and is used in its broadest meaning covering all types of sheets such as a film, plate, membrane, and the like.

As used herein, 'anti-contamination layer' of an applicator means a layer for preventing the surfaces of the applicator other than the application surface for delivering a cosmetic composition to the skin from being contaminated by the cosmetic composition or external environment.

Exemplary embodiments now will be described more fully hereinafter.

In one aspect, there is provided a cosmetic composition applicator including: an application layer for applying a cosmetic composition to the skin; an elastic layer stacked on the top of the application layer; and an anti-contamination layer stacked on the top of the elastic layer, wherein the anti-contamination layer includes an impermeable sheet. The application layer includes an application surface from which the cosmetic composition is applied to the skin from the lowermost layer of the applicator, and the elastic layer stacked on the top of the application layer may provide the applicator with a feeling of use and spreadability. The anti-contamination layer stacked on the top of the elastic layer prevents contamination caused by external environment and also prevents the cosmetic composition from coming out in drops to the hand.

According to an embodiment, the impermeable sheet included in the anti-contamination layer of the cosmetic composition applicator may be polyurethane. For example, the anti-contamination layer may have multiple layers and the layers may include different materials. For example, the anti-contamination layer may include a wet polyurethane layer and an impermeable sheet stacked on the top thereof, wherein the impermeable sheet may include at least one selected from polyurethane, polyethylene, polypropylene and polymers of polyethylene and polypropylene.

Particularly, polyurethane may include dry polyurethane and wet polyurethane. The conventional applicators mostly include wet polyurethane. However, since wet polyurethane is hydrophilic and absorbs water, it is undesirably contaminated with bacteria when it is not treated separately with an antibacterial agent. In addition, when wet polyurethane is contaminated with a cosmetic composition, the cosmetic composition is absorbed thereto immediately. This causes degradation of the aesthetic appearance of an applicator during its use. Moreover, the cosmetic composition is not removed even after washing. On the contrary, dry polyurethane has a closed cell structure having a significantly small number of pores or having no pores, and thus does not absorb water and oil.

Under these circumstances, the anti-contamination layer according to an embodiment may include a wet polyurethane layer and a dry polyurethane sheet as an impermeable sheet stacked on the top of the wet polyurethane layer. When a dry polyurethane sheet is stacked on the top of a wet polyurethane layer as mentioned above, the hydrophobic dry polyurethane can prevent absorption of contaminants and moisture, and the thickness of the anti-contamination layer may be controlled with ease through the underlying wet polyurethane layer. According to an embodiment, the dry polyurethane and the wet polyurethane may be layers having the same thickness or a different thickness. For example, the dry polyurethane sheet may be positioned on the topmost portion of the wet polyurethane in the form of a coating layer or film.

According to an embodiment, the impermeable sheet included in the anti-contamination layer of the cosmetic composition applicator is a hydrophobic sheet that does not absorb water. Thus, the impermeable sheet does not absorb water or a cosmetic composition but bounces it, and thus can fundamentally prevent the applicator from being contaminated on the surfaces other than the application surface by external environment. Therefore, even when the applicator is contaminated with a cosmetic composition, the cosmetic composition is removed by being wiped off with a tissue. As a result, the applicator can maintain a clean state even during its use. The applicator is also convenient to use, since it can be washed merely on the application surface with no problem.

According to another embodiment, the impermeable sheet included in the anti-contamination layer of the cosmetic composition applicator, i.e., the surface opposite to the application surface of the applicator may be non-porous. More particularly, the impermeable sheet may be a non-porous sheet including at most 5 pores per unit area of 5 cm×5 cm of the sheet. The impermeable sheet may have a closed cell structure in each cell so that it may not absorb any materials. Such a closed cell structure has a coating type surface and substantially has no pores, thereby preventing absorption of materials.

According to still another embodiment, the top surface of the impermeable sheet may further include a hydrophobic coating layer including a hydrophobized material in order to reinforce anti-contamination and antibacterial activities. The top surface of the impermeable sheet may further include at least one of silicon compounds and fluorine compounds. However, it may further include any material with no particular limitation, as long as the material does not absorb external contaminants or cosmetic compositions.

According to still another embodiment, the coating layer may have a thickness of 0.001-0.3 mm. More particularly, the coating layer may have a thickness of at least 0.001 mm, at least 0.01 mm, at least 0.1 mm, at least 0.5 mm, at least 1 mm or at least 2 mm, and at most 3 mm, at most 2 mm, at most 1 mm, at most 0.5 mm or at most 0.1 mm. When the coating layer has a thickness less than 0.001 mm, the function of removing contaminants of the coating layer may be affected adversely, and thus contaminants may not be removed completely but remain on the applicator. When the coating layer has a thickness larger than 0.3 mm, the applicator may be degraded in terms of a feeling of use and processability.

According to still another embodiment, the anti-contamination layer may have a thickness of 0.05-3.0 mm. More particularly, the anti-contamination layer may have a thickness of at least 0.05 mm, at least 0.1 mm, at least 0.5 mm, at least 1 mm or at least 2 mm, and at most 3 mm, at most 2 mm, at most 1 mm, at most 0.5 mm or at most 0.1 mm. However, the anti-contamination layer may have any range of thicknesses, as long as it does not adversely the feeling of use of the applicator according to the present disclosure.

According to still another embodiment, the anti-contamination layer may have a tensile strength of 3-6 kg/cm$^3$. More particularly, the anti-contamination layer may have a tensile strength of at least 3 kg/cm$^3$, at least 3.5 kg/cm$^3$, at least 4 kg/cm$^3$ or at least 5 kg/cm$^3$, and at most 6 kg/cm$^3$, at most 5.5 kg/cm$^3$, at most 5 kg/cm$^3$ or at most 4 kg/cm$^3$. However, the range of tensile strengths is not limited thereto, as long as the applicator according to the present disclosure can maintain its durability. For example, when the anti-contamination layer has a tensile strength less than 3 kg/cm$^3$, the applicator may undergo degradation in stability during long-term use and storage due to such low strength. For example, when the anti-contamination layer has a tensile strength larger than 6 kg/cm$^3$, the applicator may undergo degradation of a soft feeling and processability.

According to still another embodiment, the anti-contamination layer may have an elongation of 200-700%. For example, when the anti-contamination layer has an elongation less than 200%, the applicator may have low stability. When the anti-contamination layer has an elongation larger than 700%, the applicator may have low processability.

According to still another embodiment, the impermeable sheet of the cosmetic composition applicator may include at least one surface irregularity on the top surface thereof, and the surface irregularity may be formed by relief surface treatment. The surface irregularity may have a depth of 10-200 μm, as determined by Lext 3D Measuring Laser Microscope OLS4100 instrument at a magnification of 10×. The surface irregularity is a factor that may affect cell formation during the processing of a cosmetic composition applicator to function as a protection member, and can provide an aesthetic effect.

According to still another embodiment, the impermeable sheet or coating layer of the anti-contamination layer may be stacked on the layer underlying the same through thermal adhesion at 100-250° C. The thermal adhesion shows high processing efficiency. When the processing temperature is lower than 100° C. during the thermal adhesion, it is not possible to provide sufficient adhesion force. When the processing temperature is higher than 250° C., the adhesion force may be insufficient or melting degree may be excessive, and thus the applicator cannot be finished completely.

According to still another embodiment, the application layer of the cosmetic composition applicator may include various materials depending on use of the composition to be delivered by the applicator. For example, the application layer may include foam made of at least one selected from the group consisting of acrylonitrile butadiene rubber (NBR), styrene-butadiene rubber (SBR), natural rubber (NR), polyvinyl chloride, polyethylene, ethylene-vinyl acetate butyl rubber (EVA), latex, silicone, styrene-isoprene-styrene (SIS), styrene-ethylene-butylene-styrene (SEBS), polyvinyl alcohol (PVA), nitrile rubber, butyl rubber, chloroprene rubber (neoprene), polyolefin and polyurethane. More particularly, the silicone foam may include one made of a silicone-based elastomer.

According to still another embodiment, the elastic layer may include foam and may have a strength controlled depending on feeling of use. For example, the foam may include foam made of at least one selected from the group consisting of acrylonitrile butadiene rubber (NBR), styrene-butadiene rubber (SBR), natural rubber (NR), polyvinyl chloride, polyethylene, ethylene-vinyl acetate butyl rubber (EVA), latex, silicone, styrene-isoprene-styrene (SIS), styrene-ethylene-butylene-styrene (SEBS), polyvinyl alcohol (PVA), nitrile rubber, butyl rubber, chloroprene rubber (neoprene), polyolefin and polyurethane. More particularly, the silicone foam may include one made of a silicone-based elastomer. In a variant of the elastic layer, the foam may include coating film-processed foam or flock-processed foam. The coating film-processed foam is polymer foam, such as polyvinyl or polyurethane, coated with a film and has a smaller cell size as compared to the foam before processing with a coating film. The flock-processed foam is fiber-attached polymer foam and the fiber may be at least one selected from the group consisting of cotton, acryl, polyamide, nylon, polyester, silk and rayon. Particularly, the fiber may include cotton, acryl, polyamide, nylon, polyester, silk, cotton-acryl, cotton-rayon, nylon-polyester-cotton, and acryl-polyester.

According to still another embodiment, the cosmetic composition applicator is used to deliver a cosmetic composition to the skin, and the cosmetic composition may include a solution, emulsion or suspension, but is not limited thereto.

Particularly, the cosmetic composition may be an emulsified composition. More particularly, the cosmetic composition may be a water-in-oil (W/O) emulsion or oil-in-water (O/W) emulsion, or a dispersion, particularly oil-dispersed or water-dispersed composition.

According to still another embodiment, the cosmetic composition may be formulated into a twin cake, makeup primer, makeup base, liquid or high-viscosity foundation, concealer, lipstick, lip gloss, powder, lip liner, eyebrow, eye liner, eye shadow, blusher, UV protecting agent, lotion, cream or essence, but is not limited thereto.

In another aspect, there is provided a cosmetic product including the applicator. The cosmetic product may be a makeup cosmetic product.

According to still another embodiment, the applicator may be provided in the form of puff. According to yet another embodiment, the applicator may be provided in the form of a cosmetic container called generally 'pact', which includes a lower part capable of receiving a carrier for a cosmetic composition and an upper lid part to which a mirror may be attached, but is not limited thereto.

Modes For Invention

The examples will now be described to illustrate the present disclosure in detail. It will be appreciated by those skilled in the art that the following examples are for illustrative purposes only and not intended to limit the scope of the present disclosure.

TEST EXAMPLE 1

Manufacture of Anti-Contamination Layer and Investigation about Processability Depending on Materials Thereof In this Example, the processability of an anti-contamination layer depending on materials thereof is investigated, when stacking the anti-contamination layer is stacked on the application layer of a cosmetic composition applicator. An elastic layer made of foam is stacked on the top of an application layer made of polyurethane, and the anti-contamination layer made of each of the following materials is stacked on the elastic layer to provide a cosmetic composition applicator having a tri-layer structure.

Herein, according to Example 1, an anti-contamination layer is obtained from a composite which includes wet polyurethane, and a non-porous dry polyurethane film stacked thereon and having no absorbing property even under physical pressure for absorption.

According to Example 2, a coating layer is stacked on the anti-contamination layer according to Example 1, and the coating layer is formed by surface coating of a polymer of polyethylene and polypropylene on the anti-contamination layer to a thickness of 0.04 mm. Herein, the coating layer thickness means the thickness applied to a predetermined area and the coating layer is stacked on a 54-inch film to a thickness of 0.04 mm per 1,000 m.

Comparative Examples 1-4 are obtained from wet polyurethane, or by stacking polyethylene, polypropylene or polyolefin on the top of wet polyurethane.

Each of the anti-contamination layers and elastic layers is processed through thermal fusion at a temperature of 100-250° C. or laser fusion.

TABLE 1

| | Ex. 1 | Ex. 2 | Comp. Ex. 1 | Comp. Ex. 2 | Comp. Ex. 3 | Comp. Ex. 4 |
|---|---|---|---|---|---|---|
| Materials | Wet polyurethane + dry polyurethane film | Wet polyurethane + dry polyurethane film + surface coating | Wet polyurethane | Wet polyurethane + polyethylene | Wet polyurethane + polypropylene | Wet polyurethane + polyolefin |

TABLE 1-continued

| | Ex. 1 | Ex. 2 | Comp. Ex. 1 | Comp. Ex. 2 | Comp. Ex. 3 | Comp. Ex. 4 |
|---|---|---|---|---|---|---|
| Thermal fusion processing | ○ | ○ | ○ | X | X | X |
| Laser fusion processing | X | X | X | X | X | X |

As shown in Table 1, in the case of laser fusion, Examples 1 and 2 and Comparative Examples 1-4 failed in tri-layer fusion in the fusion processing test. Even when fusion occurs in the test, the fusion strength is too low to cause separation of a sealing portion of tri-layer fusion. On the contrary, in the case of a thermal fusion process, it can be seen that Examples 1 and 2 and Comparative 1 including an anti-contamination layer made of dry or wet polyurethane have processability.

PREPARATION EXAMPLE

Preparation of Cosmetic Composition

A cosmetic composition (foundation) including an oil phase ingredient, emulsifier, organic or inorganic UV protecting agent, pigment and an aqueous phase ingredient is obtained as shown in the following Table 2.

TABLE 2

| | | Ingredients | Wt % |
|---|---|---|---|
| Oil phase ingredients | Oily ingredient | Ozokerite | 1.0 |
| | Oily ingredient | Dicaprylyl carbonate | 10.00 |
| | UV protecting agent | Octylmethoxy cinnamate | 7.000 |
| | Thickener | Disteardimonium hectorite | 1.50 |
| | Oily ingredient | Decamethyl cyclopentasiloxane | 16.00 |
| | Emulsifier | Sorbitan sesquioleate | 2.000 |
| | Emulsifier | Lauryl PEG. PPG-18.18 methicone | 1.500 |
| | Pigment | Polymethyl methacrylate | 5.00 |
| | Pigment | Titanium dioxide/iron oxide | 7.00 |
| Aqueous phase ingredients | | Water | To 100 |
| | Emulsion stabilizer | Salt | 1.00 |

TABLE 2-continued

| | Ingredients | Wt % |
|---|---|---|
| Moisturizer | Glycerin | 8.00 |
| | Fragrance | 0.2 |
| | Total | 100 |

TEST EXAMPLE 2

Evaluation for Effect of Anti-Contamination Layer

In this Example, the anti-contamination layer of each of Examples 1 and 2 and Comparative Example 1 is tested for its effect against contaminants.

Water absorbability is measured by observing absorption of water, after 0.2 cc of water is dropped onto each anti-contamination layer. Cosmetic composition absorbability is determined by dropping 0.2 cc of a liquid cosmetic composition, i.e., the foundation of Preparation Example, onto each material and observing whether the cosmetic composition is absorbed or not.

Contaminant removal capability is evaluated by introducing 0.2 g of foundation into a schale, loading each sample (4 cm×4 cm) of the anti-contamination layers according to Examples 1 and 2 and Comparative Example 1 on the foundation, applying a weight of 5 kg thereto for 20 minutes, and then observing how much the cosmetic composition remains on the surface of each anti-contamination layer, when the cosmetic composition on each anti-contamination layer is removed by a tissue.

In this Example, contaminant removal capability is tested to determine whether each anti-contaminant layer allows easy permeation and removal of contaminants or not, when it is in contact with contaminants under pressure.

TABLE 3

| | Ex. 1 | Ex. 2 | Ex. 3 | Comp. Ex. 1 |
|---|---|---|---|---|
| Materials | Wet polyurethane + dry polyurethane film | Wet polyurethane + dry polyurethane film + surface coating | Wet polyurethane + hydrophobization treatment (surface treatment with fluorinated compound) | Wet polyurethane |
| Water absorbability | No absorption | No absorption | No absorption | Absorb |
| Cosmetic composition absorbability | No absorption | No absorption | No absorption | Absorb |
| Contaminant removal capability (spot test) | Contaminants removed | Contaminants removed | Contaminants removed | Not removed |

As shown in Table 3, the wet polyurethane material according to Comparative Example 1 absorbs water immediately and also absorbs a cosmetic composition. In the contaminant removal test, the cosmetic composition is absorbed to the wet polyurethane material and is not removed therefrom. On the contrary, the dry polyurethane materials according to Examples 1 and 2 have a closed cell structure and absorb no water, and provide excellent results in the contaminant removal test (see, FIG. 3).

TEST EXAMPLE 3

Antibacterial Activity of Cosmetic Composition Applicator Including Anti-Contamination Layer Antibacterial activity is determined by inoculating *staphylococcus aureus* and *klebsiella pneumonia* and measuring a decreasing rate. In this Example, the test method of KSK0693 is used for an antibacterial activity test and the tested strains are *staphylococcus aureus* 6538 and *klebsiella pneumonia* ATCC 4532. The test results are shown in the following Table 4.

TABLE 4

| | Ex. 1 | Ex. 2 | Comp. Ex. 1 |
|---|---|---|---|
| Materials | Wet polyurethane + dry polyurethane film | Wet polyurethane + dry polyurethane film + surface coating | Wet polyurethane |
| Antibacterial activity | Yes | Yes | No |

As shown in Table 4, when an anti-contamination layer is obtained from wet polyurethane, the applicator is susceptible to contamination caused by bacteria. On the contrary, it can be seen that when an anti-contamination layer is obtained by stacking a dry polyurethane film, the applicator has antibacterial activity.

While the exemplary embodiments have been shown and described, it will be understood by those skilled in the art that various changes in form and details may be made thereto without departing from the scope of this disclosure as defined by the appended claims. Therefore, it is intended that the scope of the present disclosure includes all embodiments falling within the spirit and scope of the appended claims.

The invention claimed is:

1. A cosmetic composition applicator comprising:

an application layer for applying a cosmetic composition to the skin;

an elastic layer stacked on the top of the application layer; and an anti-contamination layer stacked on the top of the elastic layer, wherein the anti-contamination layer comprises a wet polyurethane layer and an impermeable sheet stacked on the top thereof, and the impermeable sheet comprises at least one of polyurethane, polyethylene, polypropylene and polymers of polyethylene and polypropylene, wherein the top surface of the impermeable sheet further comprises a hydrophobic coating layer.

2. The cosmetic composition applicator according to claim 1, wherein the anti-contamination layer comprises a wet polyurethane layer and a dry polyurethane sheet stacked on the top thereof.

3. The cosmetic composition applicator according to claim 1, wherein the impermeable sheet is a non-porous sheet having at most 5 pores per unit area of 5 cm×5 cm of the sheet.

4. The cosmetic composition applicator according to claim 1, wherein the impermeable sheet comprises at least one surface irregularity on the top surface thereof, and the surface irregularity has a depth of 10-200 μm.

5. The cosmetic composition applicator according to claim 1, wherein the hydrophobic coating layer further comprises at least one of silicon compounds and fluorine compounds.

6. The cosmetic composition applicator according to claim 1, wherein the anti-contamination layer has a thickness of 0.05-3.0 mm.

7. The cosmetic composition applicator according to claim 1, wherein the anti-contamination layer has a tensile strength of 3-6 kg/cm3.

8. The cosmetic composition applicator according to claim 1, wherein the anti-contamination layer has an elongation of 200%-700%.

9. The cosmetic composition applicator according to claim 1, wherein the coating layer has a thickness of 0.001-0.3 mm.

10. The cosmetic composition applicator according to claim 1, wherein the impermeable sheet or coating layer of the anti-contamination layer is stacked on the underlying layer thereof through thermal adhesion at 100-250° C.

11. A cosmetic product comprising the cosmetic composition applicator as defined in claim 1.

12. The cosmetic product according to claim 11, which is a makeup cosmetic product.

* * * * *